US008927887B2

(12) United States Patent
Fischer

(10) Patent No.: US 8,927,887 B2
(45) Date of Patent: Jan. 6, 2015

(54) VARIABLE DEPTH CIRCUIT INTERRUPTER ASSEMBLY WITH INTERLOCK

(71) Applicant: Eaton Corporation, Cleveland, OH (US)

(72) Inventor: Kenneth Martin Fischer, Finleyville, PA (US)

(73) Assignee: Eaton Corporation, Cleveland, OH (US)

( * ) Notice: Subject to any disclaimer, the term of this patent is extended or adjusted under 35 U.S.C. 154(b) by 142 days.

(21) Appl. No.: 13/736,188

(22) Filed: Jan. 8, 2013

(65) Prior Publication Data

US 2014/0190800 A1 Jul. 10, 2014

(51) Int. Cl.

| | |
|---|---|
| ***H01H 9/20*** | (2006.01) |
| ***H01H 9/22*** | (2006.01) |
| ***H01H 3/36*** | (2006.01) |
| ***H01H 33/48*** | (2006.01) |
| *H01H 3/38* | (2006.01) |

(52) U.S. Cl.

CPC . *H01H 9/22* (2013.01); *H01H 3/36* (2013.01); *H01H 33/48* (2013.01); *H01H 3/38* (2013.01)

USPC ..... 200/50.02

(58) Field of Classification Search

USPC ..... 200/50.02, 50.12, 50.01, 331, 337; 337/196, 245, 189; 361/615, 161

See application file for complete search history.

(56) References Cited

U.S. PATENT DOCUMENTS

| | | | | |
|---|---|---|---|---|
| 4,206,329 | A | 6/1980 | Jarosz | |
| 4,602,136 | A * | 7/1986 | Deneke et al. | 200/50.06 |
| 4,626,638 | A * | 12/1986 | Samples et al. | 200/331 |
| 5,466,902 | A | 11/1995 | Blom et al. | |
| 5,493,084 | A * | 2/1996 | Whitaker et al. | 200/50.05 |
| 5,973,279 | A * | 10/1999 | Turner et al. | 200/331 |
| 6,710,697 | B1 | 3/2004 | Houck, III | |
| 8,232,488 | B2 * | 7/2012 | Haendler et al. | 200/50.12 |
| 2003/0095364 | A1 | 5/2003 | Meiners et al. | |
| 2012/0162861 | A1 * | 6/2012 | Manahan | 361/643 |

OTHER PUBLICATIONS

European Patent Office, "International Search Report and Written Opinion", Jan. 27, 2014, 8 pp.

* cited by examiner

*Primary Examiner* — Vanessa Girardi

(74) *Attorney, Agent, or Firm* — Eckert Seamans Cherin & Mellott, LLC; Brij K. Agarwal

(57) ABSTRACT

An improved circuit interrupter assembly provides enablement of an interlock feature for a circuit interrupter situated within a cabinet having an external handle for switching the circuit interrupter between ON and OFF conditions when the cabinet door is closed. The improved circuit interrupter assembly includes a motion transfer apparatus that provides such enablement of the interlock feature for cabinets of any of a variety of depths. The motion transfer apparatus includes a Bowden cable that extends between a first retention assembly situated at the door of the cabinet and a second retention assembly situated at the interlock feature of the circuit interrupter. The Bowden cable has a biased drive cable that extends between a pair of elements and which thus transfers the motion of the cabinet door in its closed position to enable cooperation with the interlock.

13 Claims, 9 Drawing Sheets

VARIABLE DEPTH CIRCUIT INTERRUPTER ASSEMBLY WITH INTERLOCK

BACKGROUND OF THE INVENTION

1. Field

The disclosed and claimed concept relates generally to circuit interrupters and, more particularly, to a circuit interrupter assembly having a circuit interrupter and an interlock within a cabinet that can be any of a wide variety of depths.

2. Related Art

Circuit interrupters are well known in the relevant art and are employed to protect portions of circuits from certain predefined overcurrent conditions, under-voltage conditions, and other predetermined conditions. Such circuit interrupters are movable between an ON condition and OFF condition and potentially also a TRIPPED condition in a known fashion.

In certain applications, a circuit interrupter may be enclosed within a metal cabinet or other enclosure in order to protect it from environmental concerns, concerns of unauthorized individuals tampering with the circuit interrupter, and other concerns. One known type of enclosure includes a handle at the exterior of the cabinet that is mechanically connected with a mechanism of the circuit interrupter within the cabinet that is movable to switch the circuit interrupter between, for example, its ON and OFF conditions. In one such exemplary configuration, a connection element in the form of a metal rod having a rectangular cross section is mounted to the circuit interrupter mechanism within the cabinet and extends toward the door in its closed position. When the door is open, the handle is disconnected from the connection element, but when the door is in its closed position, the handle is mechanically engaged with the connection element, which enables the handle on the outside of the cabinet to be rotated (by way of example) to cause the circuit interrupter to be switched between its ON and OFF conditions (again, by way of example).

While such circuit interrupter assemblies have been generally effective for their intended purposes, they have not been without limitation. For example, the cabinets in which the circuit interrupters are situated can be of any of a wide variety of depths. While the aforementioned connection element can be cut to any desired length to cause it to operatively extend between (within the interior of the cabinet) the circuit interrupter mechanism and the handle when the door is in the closed position, such an apparatus has heretofore been incapable of additionally providing an interlock feature whereby the state of the circuit interrupter cannot be changed unless the door is in its closed position. That is, known circuit interrupter assemblies have provided a connection element within the interior of the cabinet which enables the circuit interrupter to be switched between ON and OFF conditions when the door is closed, but when the door is opened, an individual can unrestrictedly manually switch the circuit interrupter between ON and OFF conditions. Such unrestricted switching of a circuit interrupter between ON and OFF conditions is undesirable for a variety of reasons.

While it has been known to provide an interlock for a circuit interrupter, no such interlock has been made operable on a circuit interrupter assembly that can be of any of a variety of depths because, in such an environment, the door can be any of a variety of distances from the interlock. While the aforementioned connection element can be cut to any desired length to enable its operation, no such feature has been provided to enable an interlock on a circuit interrupter to be operable in a similar fashion in cabinets of varying depths. It thus would be desired to enable a circuit interrupter assembly such as mentioned above to additionally have an interlock feature that can resist or limit movement of the circuit interrupter between the ON and OFF conditions when the cabinet door is opened.

SUMMARY OF THE INVENTION

An improved circuit interrupter assembly provides enablement of an interlock feature for a circuit interrupter situated within a cabinet having an external handle for switching the circuit interrupter between ON and OFF conditions when the cabinet door is closed. The improved circuit interrupter assembly includes a motion transfer apparatus that provides such enablement of the interlock feature for cabinets of any of a variety of depths. The motion transfer apparatus includes a Bowden cable that extends between a first retention assembly situated at the door of the cabinet and a second retention assembly situated at the interlock feature of the circuit interrupter. The Bowden cable has a biased drive cable that extends between a pair of elements and which thus transfers the motion of the cabinet door in its closed position to enable cooperation with the interlock.

Accordingly, an aspect of the disclosed and claimed concept is to provide an improved circuit interrupter assembly for use in a variable depth cabinet application that additionally provides an interlock feature that operates according to the position of a cabinet door.

Another aspect of the disclosed and claimed concept is to provide a circuit interrupter assembly having a motion transfer apparatus that communicates the position of a cabinet door to an interlock feature of a circuit interrupter situated in a cabinet.

Another aspect of the disclosed and claimed concept is to provide an interlock feature that can be used in circuit interrupter assemblies having a circuit interrupter situated within any of a variety of cabinets having any of a variety of cabinet depths.

Accordingly, the disclosed and claimed concept can be generally stated as including an improved circuit interrupter assembly that is structured to be connected with an electrical circuit and which can generally be stated as including a cabinet, a circuit interrupter, and a motion transfer apparatus. The cabinet has a cabinet body and a door apparatus, the cabinet body having at least first wall, the door apparatus being situated on the at least first wall and being movable between a closed position and an open position, the cabinet further having an interior region situated adjacent the at least first wall and adjacent the door apparatus in the closed position. The circuit interrupter is situated substantially entirely within the interior region, the circuit interrupter being structured to be electrically connected with the electrical circuit and being further structured to control the flow of current through at least a portion of the electrical circuit, the circuit interrupter including a mechanism that is structured to be movable to switch the circuit interrupter between an OFF condition and an ON condition. The motion transfer apparatus is structured to be cooperable with the door apparatus, the motion transfer apparatus including a transmission device that extends flexibly between the door apparatus in the closed position and the circuit interrupter, the transmission device being movable between a first position and a second position, the transmission device being in the first position when the door apparatus is in its open position, the transmission device being in the second position when the door apparatus is in its closed position. The mechanism includes an interlock that is cooperable with the transmission device and which, in the first position of the transmission device, is structured to resist at least one of movement of the circuit interrupter from the ON condition to the OFF condition, and movement of the circuit interrupter from the OFF condition to the ON condition. The interlock in the second position of the transmission device is structured to permit movement of the circuit interrupter between the ON and OFF conditions.

BRIEF DESCRIPTION OF THE DRAWINGS

A further understanding of the disclosed and claimed concept can be gained from the following Description when read in conjunction with the accompanying drawings, each of which is schematic in nature, and wherein:

Similar numerals refer to similar parts throughout the specification.

DESCRIPTION

Figure 1:
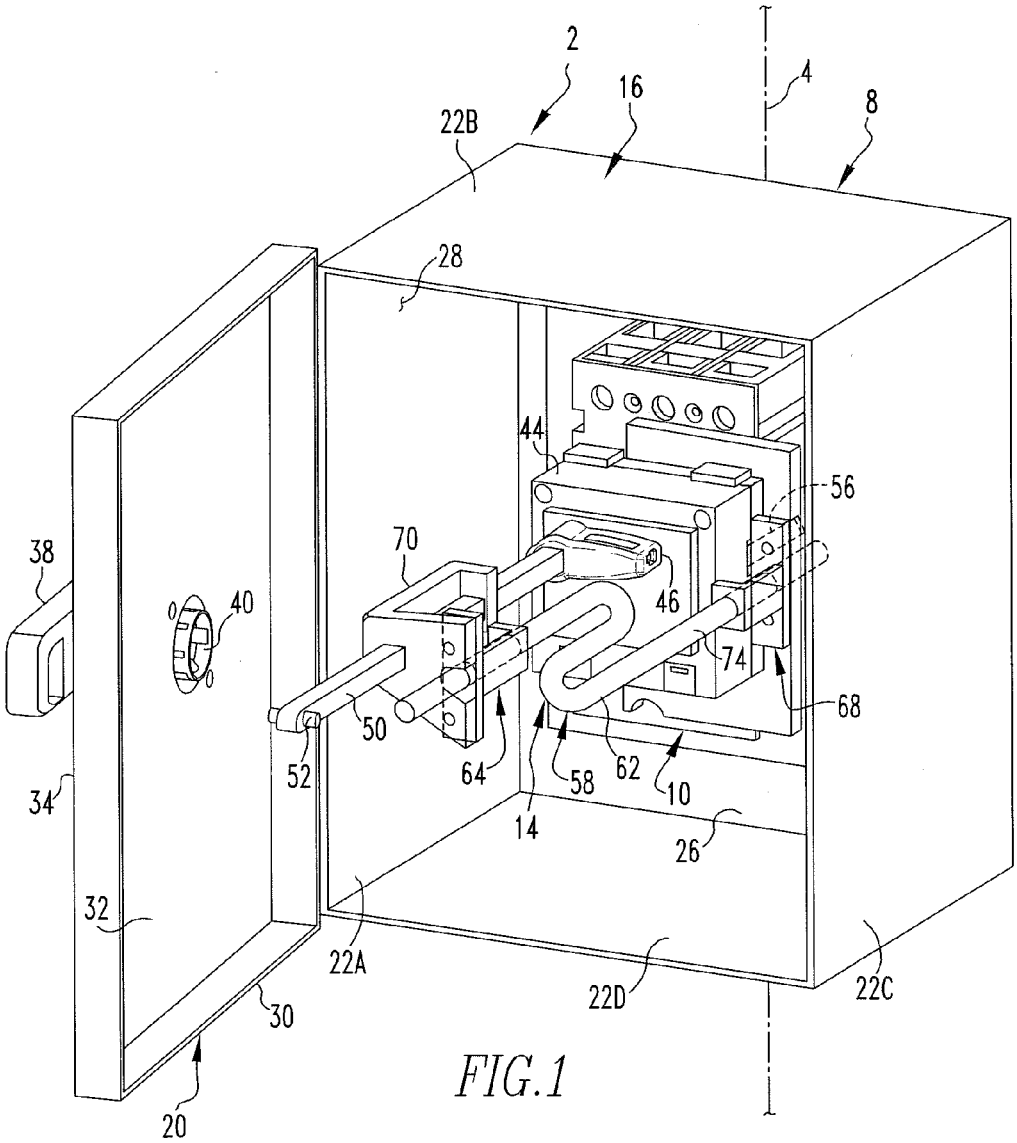
FIG. 1 is a perspective depiction of an improved circuit interrupter assembly in accordance with the disclosed and claimed concept having a circuit interrupter situated within a cabinet and with a door of the cabinet in an open position.

An improved circuit interrupter assembly 2 in accordance with the disclosed and claimed concept is depicted generally in FIG. 1. The circuit interrupter assembly 2 is electrically connectable with an electrical circuit 4. The circuit interrupter assembly 2 includes a cabinet 8 within which is disposed a circuit interrupter 10 that is electrically connected with the electrical circuit 4 in a known fashion. Advantageously, the circuit interrupter assembly 2 includes a motion transfer apparatus 4 that enables an interlock feature of the circuit interrupter 10 to be cooperable with a door 30 of the cabinet 8.

The cabinet 8 can be said to include a cabinet body 16 and a door apparatus 20 that are cooperable to enclose the circuit interrupter 10. In the depicted exemplary embodiment, the cabinet body 16 is of a rectangular configuration having four walls 22ABCD, with the door apparatus 20 being pivotably mounted to the wall 22A. The cabinet body 16 further includes a base 26 to which the circuit interrupter 10 is mounted and from which the walls 22ABCD each extend. The cabinet body 16 can be said to include an interior region 28 that is situated adjacent each of the walls 22ABCD and the base 26.

Figure 6:
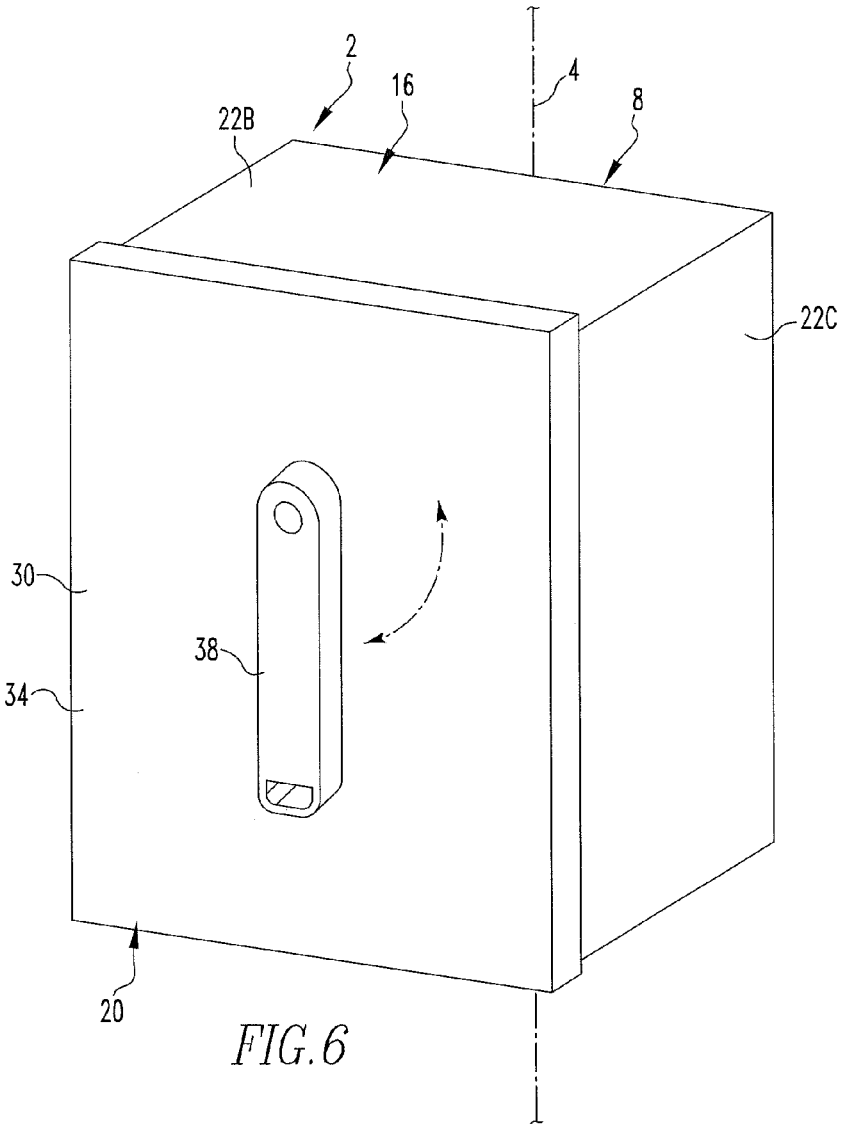
FIG. 6 is a view of the exterior of the cabinet with the door in the closed position and that corresponds with the exemplary ON condition of the circuit interrupter of FIG. 5.
Figure 7:
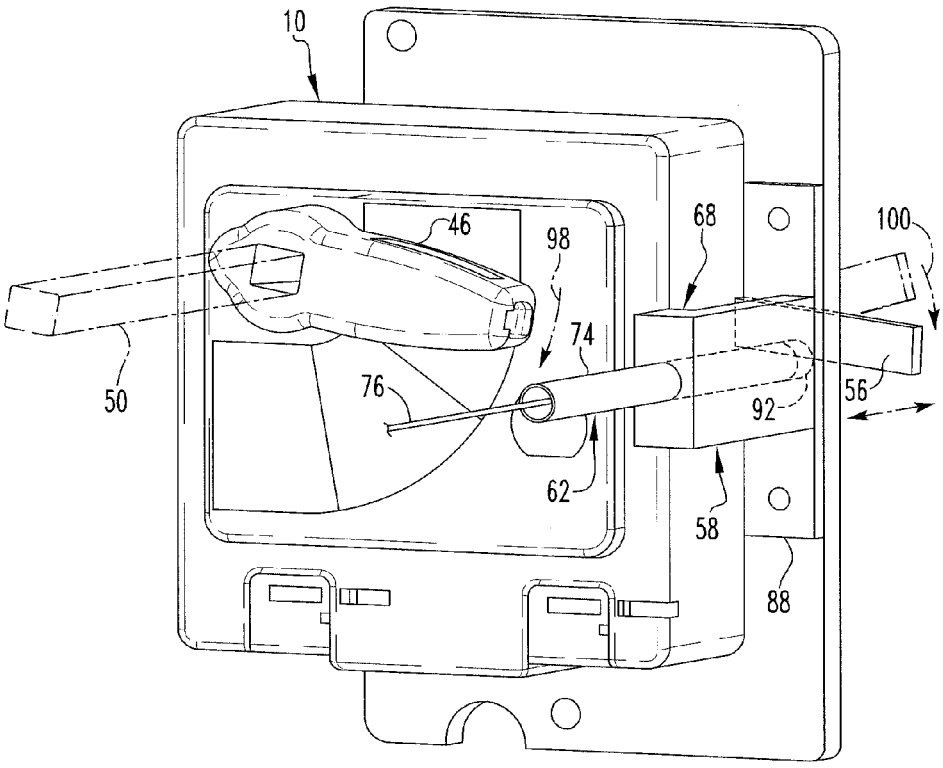
FIG. 7 is a view similar to FIG. 4, except depicting the transmission device in the first position and depicting an interlock of the circuit interrupter resisting movement of the circuit interrupter to the exemplary ON condition.

The door apparatus 20 includes the aforementioned door 30 which is mounted to the wall 22A and which is movable between an open position, as is depicted generally in FIG. 1, and a closed position as is depicted generally in FIG. 6. The door 30 has a first side 32 that is situated adjacent the interior region 28 in the closed position of the door 30. The door 30 further includes a second side 34 that is situated opposite the first side 32.

The door apparatus 20 further includes a pivotable handle 38 that is rotatably situated on the second side 34. As can be seen in FIG. 1, the handle 38 extends through a hole formed in the door 30 and includes a receptacle 40 that is internally splined and which is accessed from the first side 32. As will be set forth in greater detail below, the receptacle 40 is cooperable with a connection element 50 of the circuit interrupter 10 to enable the handle 38 in the closed position of the door to switch the circuit interrupter 10 between an ON condition and an OFF condition of the circuit interrupter 10, by way of example.

The circuit interrupter 10 can be said to include a housing 44 upon which is situated a mechanism 46 that is movable to switch the circuit interrupter 10 between its ON and OFF conditions. In the depicted exemplary embodiment, the circuit interrupter 10 is depicted in FIGS. 1, 4, and 7-8 as being in its exemplary OFF condition, whereas in FIGS. 5 and 6 the circuit interrupter 10 in its ON exemplary condition.

The circuit interrupter 10 further includes the aforementioned connection element 50 that is mounted to a rectangular hole formed in a portion of the mechanism 46 and which has a transverse pin 52 situated in the end opposite the circuit interrupter 10. When the door 30 is in its closed position, the pin 52 is cooperable with the splines formed in the receptacle 40 of the handle 38 to enable a rotation of the handle 38 to correspondingly rotate the mechanism 46 and to cause the circuit interrupter 10 to be switched between its ON and OFF conditions. In this regard, it can be understood that the connection element 50 and the handle 38 are operatively connected together in the closed position of the door apparatus 20 and are disconnected from one another, as is depicted generally in FIG. 1, in the open position of the door apparatus 20.

The circuit interrupter 10 further includes an interlock 56 which is depicted in FIGS. 4-5 and 7-8 as being a tab, but it is understood that the depicted tab cooperates with other structures (not expressly depicted herein, but which are nevertheless known) that are internal to the circuit interrupter 10 and that can limit the ability of the mechanism 46 to be moved to switch the circuit interrupter 10 between its ON and OFF conditions. The interlock 56 is cooperable with the motion transfer apparatus 14 as will be set forth in greater detail below to permit such movement of the circuit interrupter 10 between its ON and OFF conditions or to resist such movement.

Figure 2A:
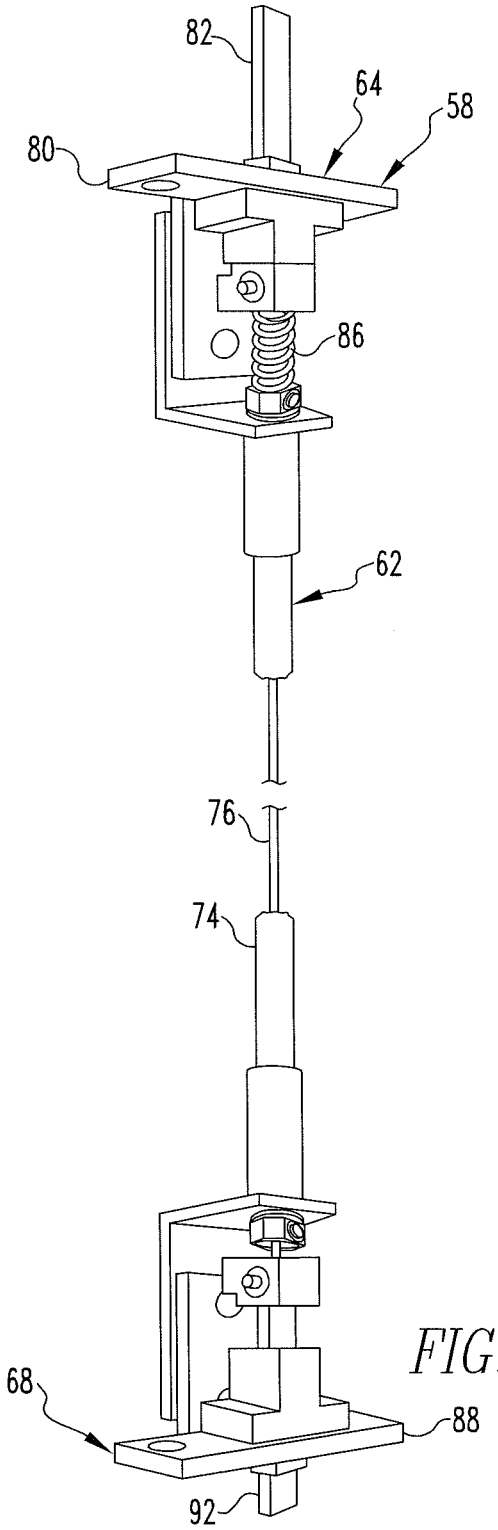
FIG. 2A is a depiction of a transmission device of the circuit interrupter assembly of FIG. 1, with the transmission device being in a first position that corresponds with the door of FIG. 1 being in its open position.
Figure 2B:
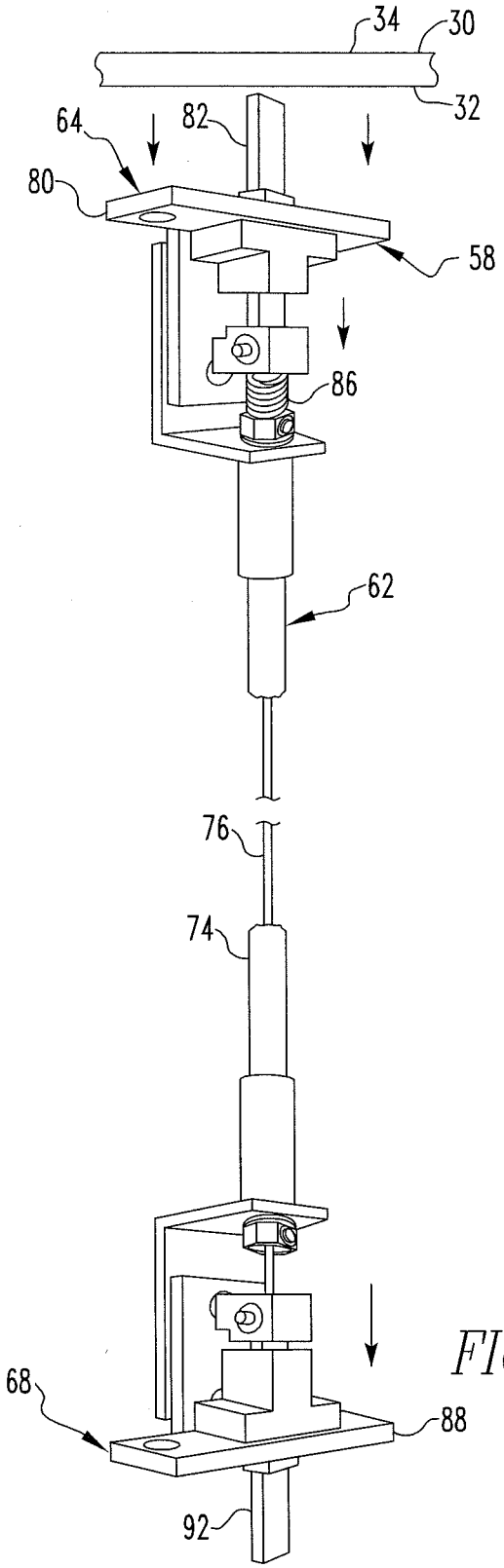
FIG. 2B is a view similar to FIG. 2A, except depicting the transmission device in a second position that corresponds with the door of FIG. 1 being in a closed position.

The motion transfer apparatus 14 can be said to include a transmission device 58 that is depicted generally in FIGS. 2A and 2B and which enables the open or closed positions of the door 30 to be communicated to the interlock 56, whereby the position of the door 30 causes the interlock 56 to either permit movement or resist movement of the circuit interrupter 10 between its ON and OFF conditions. The transmission device 58 extends flexibly between the door apparatus 20 in the closed position and the circuit interrupter 10.

Figure 3:
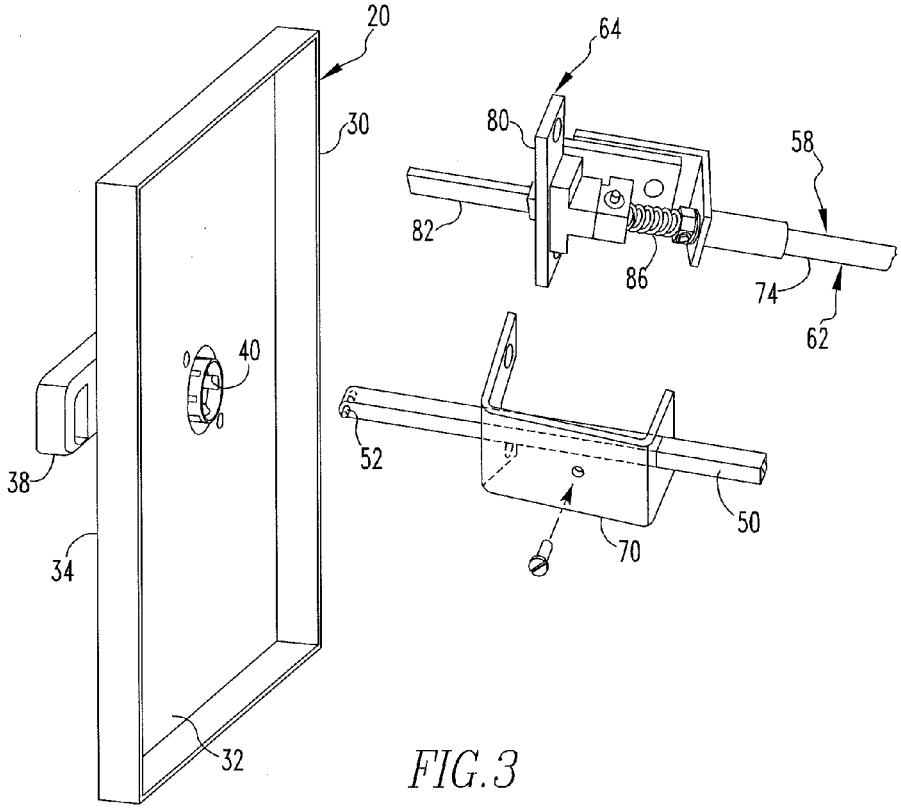
FIG. 3 is an exploded depiction of a portion of the transmission device of FIG. 2A and a connection element of the circuit interrupter in relation to the door.

As can be seen in FIGS. 2A and 2B, the transmission device 58 includes a Bowden cable 62, a first retention assembly 64, and a second retention assembly 68. The Bowden cable 62 extends between the first and second retention assemblies 64 and 68. As will be described in greater detail below, the first retention assembly 64 is mounted to the connection element 50 and retains a first end of the transmission device 58 in a position wherein it is engaged by the door 30 when in the closed position. The motion transfer apparatus 14 further includes a clamp 70 (FIGS. 1 and 3) that mounts the first retention assembly 64 to the connection element 50. The second retention assembly 68 is configured to retain a second end of the transmission device 58 in a position whereby it is cooperable with the interlock 56.

As can further be understood from FIGS. 2A and 2B, the Bowden cable 62 can be said to include a semi-rigid sheath 74 within which is movably disposed a flexible drive cable 76. The sheath 74 can be said to be semi-rigid since its axial dimension, i.e., its length, is generally fixed, but the sheath 74 itself is flexible in various directions, such as is depicted in FIG. 1 as forming a backward "S" shape, by way of example. The drive cable 76 is translatable within the sheath 74 in a known fashion to transfer motion between the first retention assembly 64 and the second retention assembly 68.

More particularly, the first retention assembly 64 can be said to include a first mount 80 that is connectable to the clamp 70 and to which a first end of the sheath 74 is affixed. The first retention assembly 64 further includes an engagement element 82 that is connected with a first end of the drive cable 76 and further includes a biasing element in the exemplary form of a coil spring 86. In the depicted exemplary embodiment, the biasing element (i.e., the coil spring 86) biases the drive cable 76 and thus the transmission device 58 toward a first position which is depicted generally in FIG. 2A and which is characterized by the engagement element 82 protruding generally to its fullest extent from the first mount 80, which occurs when the door 30 in its open condition.

The second retention assembly 68 includes a second mount 88 to which a second end of the sheath 74 is affixed and which is connectable to the housing 44 of the circuit interrupter 10 in proximity to the interlock 56. The second retention assembly 68 further includes an operational element 92 that is connected with a second end of the drive cable 76 and which is depicted as being similar in shape to the engagement element 82 albeit at an opposite end of the drive cable 76.

The transmission device 58 is movable between the first position depicted generally in FIG. 2A and a second position that is depicted generally in FIG. 2B and that is characterized by the operation element 92 protruding from the second mount 88 a relatively greater distance than in the first position of FIG. 2A. That is, the door 30 in the closed position engages and translates the engagement element 82, thereby compressing the coil spring 86 and translating the drive cable 76 within the sheath 74 to cause the operation element 92 to correspondingly translate and protrude a relatively greater distance from the second mount 88. Such motion of the transmission device 58 as a result of the door 30 being moved to its closed position can be said to transfer the motion of the closed door 30 to the interlock 56 of the circuit interrupter 10. That is, such extended protrusion of the operation element 92 from the second mount 88 enables the operation element 92 to be cooperable with the interlock 56 and, more particularly, to communicate to the interlock 56 the position of the door 30, whether open or closed, to cause the interlock 56 to either resist or permit, respectively, movement of the mechanism 46 that switches the circuit interrupter 10 between its ON and OFF conditions.

Figure 4:
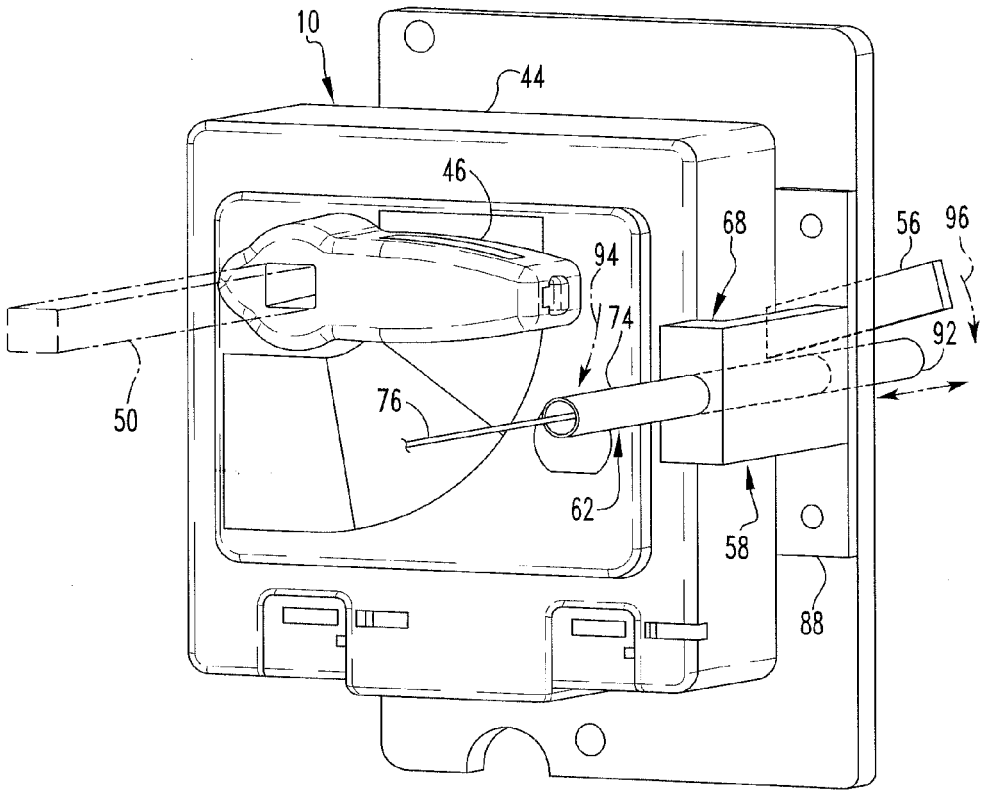
FIG. 4 is a perspective depiction of a portion of the circuit interrupter with a portion of the transmission device being in the second position and with the circuit interrupter in an exemplary OFF condition.

More particularly, the second end of the transmission device 58 is depicted in FIG. 4 as being in the second position which, as mentioned elsewhere herein, corresponds with the closed position of the door 30. This position of the motion transfer device 58 is depicted in FIG. 2B in conjunction with the door 30, which is depicted schematically in FIG. 2B as being in its closed position. For the sake of completeness, it is noted that the operation element 92 is depicted in an exaggeratedly protruding fashion in FIG. 1 solely for purposes of illustration, it being understood that in the open position of the door 30 (which corresponds with the first position of the transmission device 58), the operation element 92 would extend, if at all, a much lesser extent than is actually depicted in FIG. 1.

Figure 5:
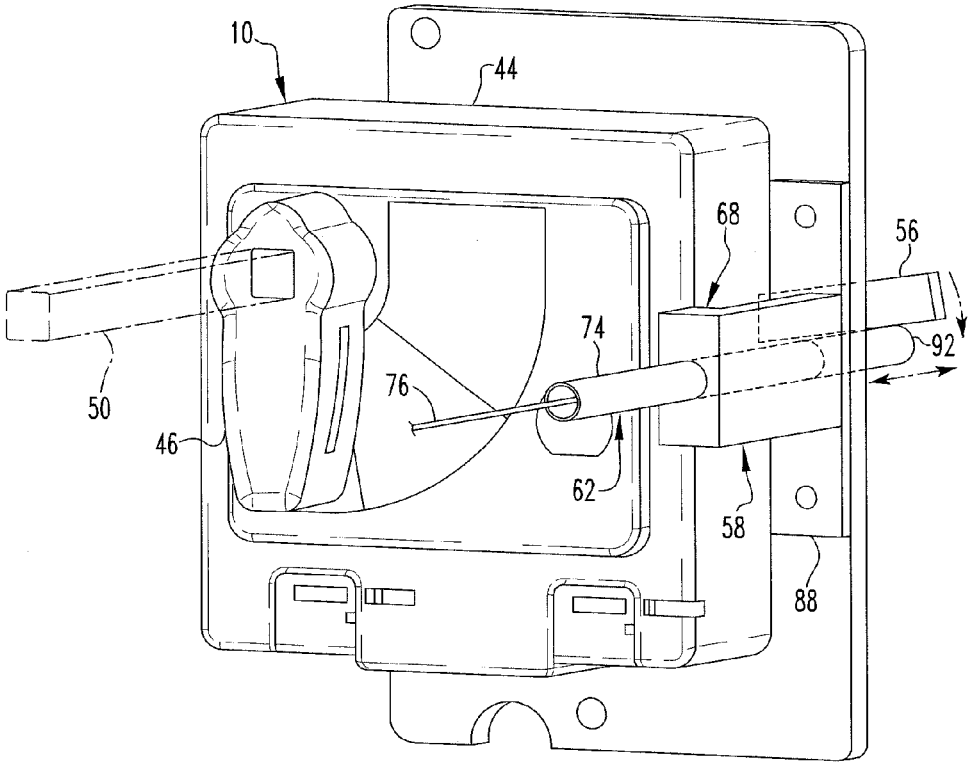
FIG. 5 is a view similar to FIG. 4, except depicting a mechanism of the circuit interrupter in an exemplary ON condition.

Further regarding FIG. 4, when the transmission device 58 is in its second position and the operation element 92 protrudes in the depicted fashion from the second mount 88, the operation element 92 is cooperable with the interlock 56 upon an initial pivoting of the mechanism 46 from the position depicted generally in FIG. 4 (which corresponds with the exemplary OFF condition of the circuit interrupter) toward the position of the mechanism 46 that is depicted generally in FIG. 5 (and which corresponds with the exemplary ON condition of the circuit interrupter 10). That is, the interlock 56 is depicted in FIG. 4 as being at most only slightly rotationally spaced from the protruding operation element 92. Upon an initial rotation of the mechanism 46 in the clockwise direction, as is indicated with the arrow 94 in FIG. 4, the interlock 56 will likewise rotate in the same clockwise direction, as is indicated at the arrow 96 in FIG. 4, until the interlock 56 engages the protruding operation element 92. Upon such rotational engagement of the interlock 56 with the protruding operation element 92, the interlock 56 becomes unlocked and permits the mechanism 46 to be further rotated toward the position depicted generally in FIG. 5 which, as mentioned above, corresponds with the exemplary ON condition of the circuit interrupter 10. As set forth elsewhere herein, FIGS. 4 and 5 correspond with the closed position of the door 30, which is depicted generally in FIG. 6, which itself depicts the handle 38 as being in a different rotational position than that depicted generally in FIGS. 1 and 3.

However, if the door 30 is in the open position, such as is depicted generally in FIG. 1, the transmission device 58 is in its first position because the engagement element 82 and the door 30 are disengaged. In such a condition, and as is depicted generally in FIG. 7, the operation element 92 does not protrude as far from the second mount 88. As a result, an initial rotation of the mechanism 46, as is indicated at the numeral 98 in FIG. 7, will cause the interlock 56 to rotate, as is indicated at the arrow 100 in FIG. 7, past the point at which it would otherwise contact the operation element 92 if the operation element 92 had protruded farther from the second mount 88. Such rotation of the interlock 56 in FIG. 7 causes the interlock 56 to lock in a known fashion and to resist further movement of the mechanism 46 toward the ON condition of the circuit interrupter 10. As such, it can be understood that when the door 30 is in its open position, the transmission device 58 is in its first position, and the interlock 56 will resist movement of the circuit interrupter 10 between the OFF and ON conditions. To reiterate, however, when the door is in its closed position, as is depicted generally in FIG. 6, the transmission device 58 is in its second position (as is depicted generally in FIGS. 2B, 4, and 5) which permits the mechanism 46 to be moved to cause the circuit interrupter 10 to be switched between its OFF and ON conditions.

Figure 8:
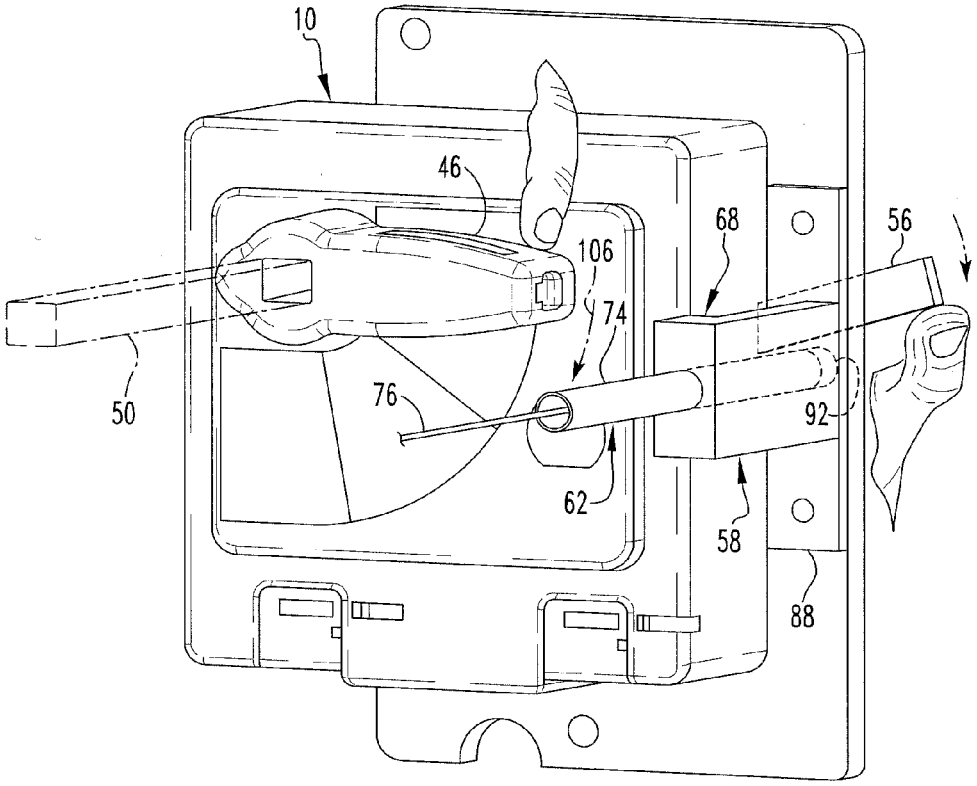
FIG. 8 is a view similar to FIG. 7, except depicting a technician manually overriding the interlock and manually changing the state of the circuit interrupter mechanism.

FIG. 8 depicts the way in which a technician can defeat the operation of the interlock 56 when the door 30 is in its open position. That is, even if the transmission device 58 is in its first position, it being reiterated that the coil spring 86 biases the transmission device 58 toward its first position, the technician can insert a tool or the technician's hand to a position in contact with the interlock 56 to hold the interlock 56 in the position depicted generally in FIG. 8. Retaining the interlock 56 in the position depicted generally in FIG. 8 permits the mechanism 46 to be manually pivoted, as is indicated with the arrow 106. As such, while the motion transfer apparatus 14 enables the position of the door 30 to be transferred to the interlock 56 and to thereby control the ability of the mechanism 46 to be moved to switch the circuit interrupter 10 between its OFF and ON conditions, the interlock 56 can be manually defeated by an affirmative action by the technician to enable the circuit interrupter 10 to be switched between its OFF and ON conditions depending upon the needs of the particular application.

The improved circuit interrupter assembly 2 thus advantageously provides a motion transfer apparatus 14 which communicates the position of the door 30 to the interlock 56 to control the ability of the circuit interrupter 10 to be switched between its ON and OFF conditions. Since the transmission device 58 is flexible, it can be twisted in various configurations, such as the reverse "S" shape depicted generally in FIG. 1, while still communicating to the interlock 56 the position of the door 30. In this regard, therefore, it can be understood that the transmission device 58 can be used with different cabinet bodies having any of a variety of depths. That is, the connection element 50 typically is provided at a given (long) length which is then cut, as appropriate, to a length that enables the connection element 50 to operatively extend between the mechanism 46 and the receptacle 40 in the closed position of the door. By employing the clamp 70 to retain the first retention assembly 64 in proximity to the door 30 in its closed position, the transmission device 58 is operable to communicate to the interlock 56 the particular position of the door, i.e., open or closed, regardless of the depth of the cabinet 8 and the corresponding length of the connection element 50. This is because the Bowden cable 62 is flexible and is configured to communicate in a controlled fashion a mechanical movement at one locations, i.e., at the door 30, to a different location, i.e., at the interlock 56. The transmission device 58 thus advantageously can be sold as a single unit that is applicable to cabinets 8 having any of a variety of depths, which is versatile, cost effective, and advantageous.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit interrupter assembly structured to be connected with an electrical circuit and comprising:

a cabinet having a cabinet body and a door apparatus, the cabinet body having at least a first wall, the door apparatus being situated on the at least first wall and being movable between a closed position and an open position, the cabinet further having an interior region situated adjacent the at least first wall and adjacent the door apparatus in the closed position;

a circuit interrupter situated substantially entirely within the interior region, the circuit interrupter being structured to be electrically connected with the electrical circuit and being further structured to control the flow of current through at least a portion of the electrical circuit, the circuit interrupter comprising a mechanism that is structured to be movable to switch the circuit interrupter between an OFF condition and an ON condition;

a motion transfer apparatus structured to be cooperable with the door apparatus, the motion transfer apparatus comprising a transmission device that extends flexibly between the door apparatus in the closed position and the circuit interrupter, the transmission device being movable between a first position and a second position and being biased toward the first position, the transmission device being in the first position when the door apparatus is in its open position, the door engaging the transmission device and overcoming the bias to move the transmission device to the second position when the door apparatus is in its closed position;

the mechanism comprising an interlock that is cooperable with the transmission device and which, in the first position of the transmission device, is structured to resist at least one of:

movement of the circuit interrupter from the ON condition to the OFF condition, and movement of the circuit interrupter from the OFF condition to the ON condition; and the interlock in the second position of the transmission device being structured to permit movement of the circuit interrupter between the ON and OFF conditions.

2. A motion transfer apparatus as set forth in claim 1 and structured to cooperate with the cabinet and circuit interrupter as set forth in claim 1.

3. The circuit interrupter assembly of claim 1 wherein:

the door apparatus comprises a door and a handle, the door having a first side and a second side, the first side being situated adjacent the interior region in the closed position of the door apparatus, the second side being disposed opposite the first side, the handle being situated on the door adjacent the second side;

the circuit interrupter further comprising a housing on which the mechanism is situated and a connection element that is structured to extend between the handle and the mechanism in the closed position of the door apparatus; and the handle in the closed position of the door apparatus being structured to operate the connection element and the mechanism to move the circuit interrupter between the ON and OFF conditions.

4. The circuit interrupter assembly of claim 3 wherein the motion transfer apparatus further comprises a first retention assembly that is structured to retain a first end of the transmission device in a position wherein it is engaged by the door apparatus in its closed position.

5. The circuit interrupter assembly of claim 4 wherein the connection element and the handle are structured to be operatively connected in the closed position of the door apparatus and are structured to be disconnected in the open position of the door apparatus, and wherein the first retention assembly is mounted to the connection element.

6. The circuit interrupter assembly of claim 4 wherein the motion transfer apparatus further comprises a second retention assembly that is structured to retain a second end of the transmission device in another position whereby in the second position it is cooperable with the interlock.

7. The circuit interrupter assembly of claim 6 wherein the first retention assembly is mounted to the connection element, and wherein the second retention assembly is mounted to the circuit interrupter.

8. A circuit interrupter assembly structured to be connected with an electrical circuit and comprising:

a cabinet having a cabinet body and a door apparatus, the cabinet body having at least a first wall, the door apparatus being situated on the at least first wall and being movable between a closed position and an open position, the cabinet further having an interior region situated adjacent the at least first wall and adjacent the door apparatus in the closed position;

a circuit interrupter situated substantially entirely within the interior region, the circuit interrupter being structured to be electrically connected with the electrical circuit and being further structured to control the flow of current through at least a portion of the electrical circuit, the circuit interrupter comprising a mechanism that is structured to be movable to switch the circuit interrupter between an OFF condition and an ON condition;

a motion transfer apparatus structured to be cooperable with the door apparatus, the motion transfer apparatus comprising a transmission device that extends flexibly between the door apparatus in the closed position and the circuit interrupter, the transmission device being movable between a first position and a second position, the transmission device being in the first position when the door apparatus is in its open position, the transmission device being in the second position when the door apparatus is in its closed position;

the mechanism comprising an interlock that is cooperable with the transmission device and which, in the first position of the transmission device, is structured to resist at least one of:

movement of the circuit interrupter from the ON condition to the OFF condition, and movement of the circuit interrupter from the OFF condition to the ON condition;

the interlock in the second position of the transmission device being structured to permit movement of the circuit interrupter between the ON and OFF conditions; and wherein the motion transfer apparatus further comprises a first retention assembly and a second retention assembly, and wherein the transmission device comprises a Bowden cable that extends between the first retention assembly and the second retention assembly, the Bowden cable comprising a sheath and a drive cable, the first retention assembly comprising a first mount to which a first end of the sheath is connected, the first mount being situated adjacent the door apparatus in its closed position, the second retention assembly comprising a second mount to which a second end of the sheath is connected, the second mount being situated adjacent the interlock.

9. A motion transfer apparatus as set forth in claim 8 and structured to cooperate with the cabinet and circuit interrupter as set forth in claim 8.

10. The circuit interrupter assembly of claim 8 wherein the first retention assembly further comprises an engagement element that is movably disposed on the first mount and is connected with a first end of the drive cable, the engagement element being structured to be engageable by the door apparatus moving toward its closed position to move the transmission device toward its second position.

11. The circuit interrupter assembly of claim 10 wherein the second retention assembly further comprises an operation element situated at a second end of the drive cable and which, in the second position, is structured to be cooperable with the interlock.

12. The circuit interrupter assembly of claim 10 wherein the transmission device is biased in a direction generally toward its first position.

13. The circuit interrupter assembly of claim 12 wherein the first retention assembly further comprises a biasing element that is interposed between the mount and the engagement element and that biases the engagement element in a direction generally toward the door apparatus in its closed position.

* * * * *